US005193593A

United States Patent [19]

Denis et al.

[11] Patent Number: 5,193,593

[45] Date of Patent: Mar. 16, 1993

[54] PACKAGE FILLING METHOD AND APPARATUS

[75] Inventors: Jean M. Denis, Pringy; Patrick Devos, Le Vaudoue, both of France

[73] Assignee: Colgate-Palmolive Company, New York, N.Y.

[21] Appl. No.: 841,860

[22] Filed: Feb. 27, 1992

Related U.S. Application Data

[63] Continuation of Ser. No. 566,903, Aug. 13, 1990, abandoned.

[51] Int. Cl.[5] ..... B67C 3/02

[52] U.S. Cl. ..... 141/10; 141/31; 141/114; 141/119; 141/120; 141/126; 141/255; 141/263; 141/DIG. 1; 239/120; 222/571; 222/108

[58] Field of Search ..... 141/1, 10, 31, 114–116, 141/119, 120, 121, 126, 255, 267, 284, 286, 311 A, DIG. 1; 222/108, 107, 189, 571; 239/120

[56] References Cited

U.S. PATENT DOCUMENTS

| | | | |
|---|---|---|---|
| 1,881,106 | 10/1932 | Vogt et al. | 141/263 X |
| 2,958,171 | 11/1960 | Deckers | 141/263 X |
| 3,056,436 | 10/1962 | Fechheimer et al. | 141/116 X |
| 3,093,165 | 6/1963 | Risser | 141/264 X |
| 3,324,904 | 6/1967 | Crothers | 141/115 X |
| 3,559,702 | 2/1971 | Riesenberg | 141/147 X |
| 3,792,724 | 2/1974 | Hunter | 141/115 |
| 4,119,276 | 10/1978 | Nelson | 239/590.3 |
| 4,185,669 | 1/1980 | Jevakohoff | 141/59 |
| 4,337,802 | 7/1982 | Kennedy et al. | 141/1 |
| 4,535,823 | 8/1985 | Powers | 141/374 X |
| 4,576,210 | 3/1986 | Lepisto | 141/115 |
| 4,606,382 | 8/1986 | Biller et al. | 141/1 |
| 4,711,277 | 12/1987 | Clish | 141/311 A |
| 4,730,786 | 3/1988 | Nelson | 239/590.3 |
| 4,749,010 | 6/1988 | Petell | 141/59 |
| 4,958,669 | 9/1990 | Ohta | 141/311 A |
| 5,094,278 | 3/1992 | Argo et al. | 141/311 A |

FOREIGN PATENT DOCUMENTS

| | | | |
|---|---|---|---|
| 0155186 | 9/1985 | European Pat. Off. | 141/45 |
| 1190292 | 4/1970 | United Kingdom . | |

OTHER PUBLICATIONS

Western Electric Technical Digest #31 Jul. 1973 Marshall.

*Primary Examiner*—Ernest G. Cusick

*Attorney, Agent, or Firm*—Michael J. McGreal; Robert C. Sullivan

[57] ABSTRACT

A valve is provided for filling containers which eliminates splashing and dripping. As the container is being filled, the valve is moved upwardly so as to be a set distance above the level of the contents of the container during filling. In addition, the liquid passes through an anti-splash screen as it exits the valve. In a further feature, associated with the screen are one or more suction units which operate at the cessation of liquid flow from the valve to remove liquid from the screen and preventing dripping. The combination of the valve moving upwardly during container filling, a screen, and suction units associated with the screen function to prevent splashing during filling and dripping after filling.

11 Claims, 5 Drawing Sheets

PACKAGE FILLING METHOD AND APPARATUS

This application is a continuation of application Ser. No. 07/566,903 filed Aug. 13, 1990, now abandoned.

FIELD OF THE INVENTION

This invention relates to a method and apparatus for filling packages, such as pouches, with liquids and preventing a splashing of the filling substance. In particular, this invention relates to a nozzle which includes means to prevent excess liquid from flowing into the pouch or bottle and means to maintain the exit of the nozzle above the level of the liquid in the pouch or bottle during filling, and the method of using this valve to fill pouches and bottles.

BACKGROUND OF THE INVENTION

Many problems are confronted in the filling of pouch containers. One of these problems is the splashing of the liquid as it is being filled into the container. Another problem is a dripping from the nozzle after the container has been filled. Such splashing and dripping will result in a contamination of the seal area of the container. Excessive splashing can also result in the container having less than the stated amount of the liquid. When the container is a pouch, the problem is more the contamination of the seal area. This is the case since in many instances the pouch is being formed and filled in the same sequence. That is, the pouch is formed from a sheet of film, and when formed to a point having a sealed bottom and sealed sides, it is filled. Then the top is sealed.

A problem arises if the region that is to comprise the top seal has become coated with the substance being filled into the pouch container. This is caused by a turbulent flow splashing of the substance in the pouch during filling and a dripping from the nozzle at the termination of filling. However, regardless of the exact cause of the coating of the interior surface with product, it is known to be deleterious to the subsequent formation of good seals. It is therefore an objective to minimize this splashing and the dripping from a nozzle after a filling cycle.

BRIEF SUMMARY OF THE INVENTION

The present invention is directed to a method and apparatus for filling container packages, and in particular for filling flexible film pouches. The apparatus consists of a nozzle which comprises an elongated tubular member having an aperture therethrough for the intermittent flow of a liquid. At the upper end, there is a means for the introduction of the liquid, and at the lower end, at least one screen means to induce a laminar flow and to decrease drip formation upon the cessation of the flow of the liquid. At the lower end in the region of one or more screens, there can be a suction means to remove excess liquid from the screen area. In addition, the entire elongated tubular member which comprises the nozzle can be moved upwardly as a container is being filled in order to maintain the exit end of the nozzle at a set distance above the level of the liquid in the container and thus minimize the impact energy of the fluid as it enters the package.

In the method, the nozzle is inserted into the pouch and the nozzle opened to flow liquid into the container. Liquid flows into the container and concurrently the nozzle moves upwardly so as to maintain the exit of the nozzle above the level of the liquid in the container during the filling sequence. The nozzle is closed when the pouch is filled and the suction means is then actuated to remove any excess liquid from the region of the screen or screens to prevent drip formation. The nozzle is then ready for another filling sequence.

When a pouch is being filled, the nozzle will usually be a part of a form/fill sequence. When the pouch has been formed to a point where there are sealed bottom and sides, the pouch is in a condition for filling. At this point, the nozzle is near the bottom of the pouch. The nozzle is activated to flow a given amount of liquid into the pouch. Concurrently the nozzle is raised to maintain the nozzle above the level of the liquid flowing into the pouch. When the given amount of liquid has flowed into the pouch the flow ceases and by means of suction excess liquid in the region of the one or more screens of the nozzle is removed by means of the suction. This reduces drip formation upon the cessation of the flow of liquid.

DETAILED DESCRIPTION OF THE INVENTION

Figure 1:
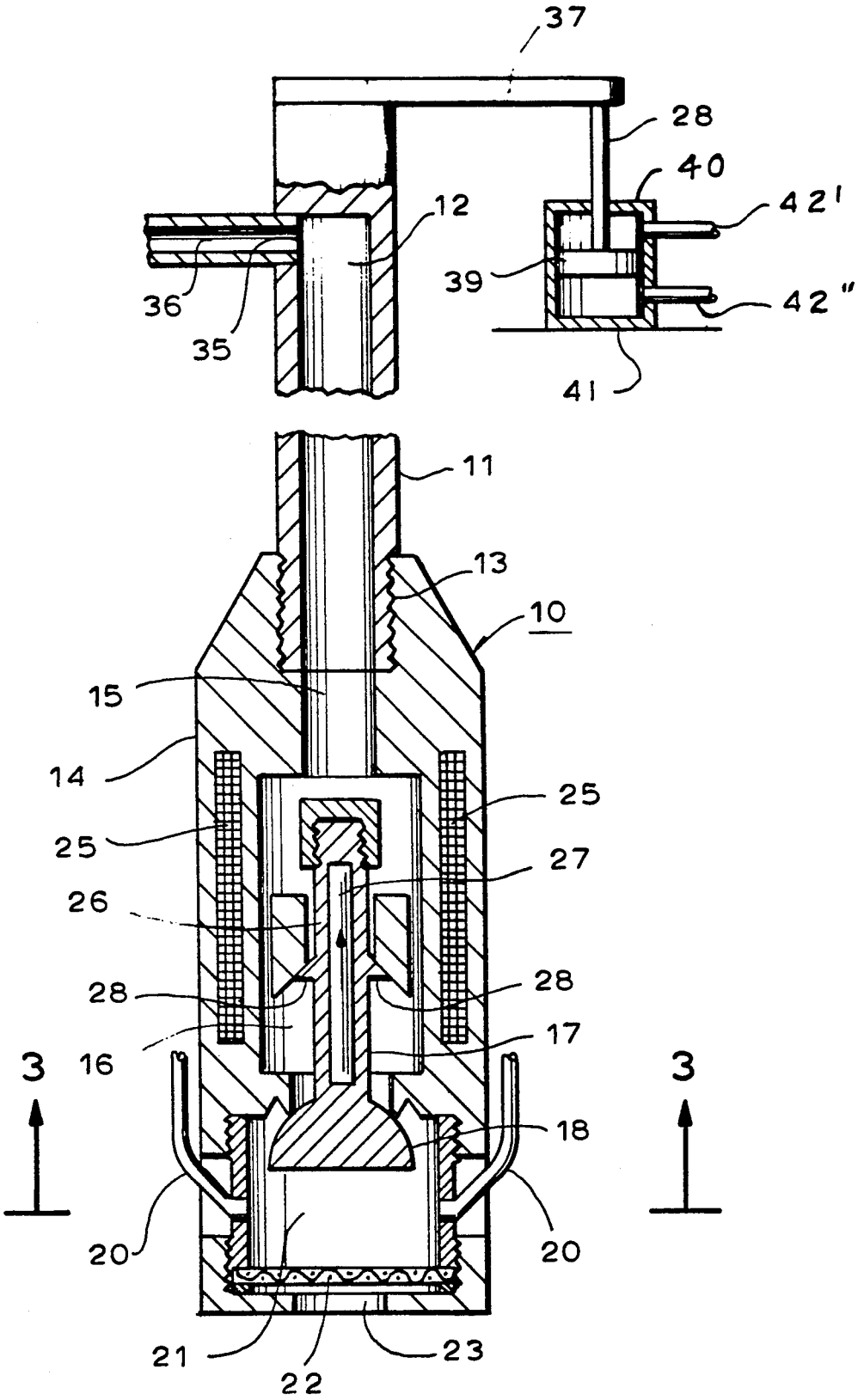
FIG. 1 is an elevational view in section of the fill nozzle assembly in a closed position.
Figure 2:
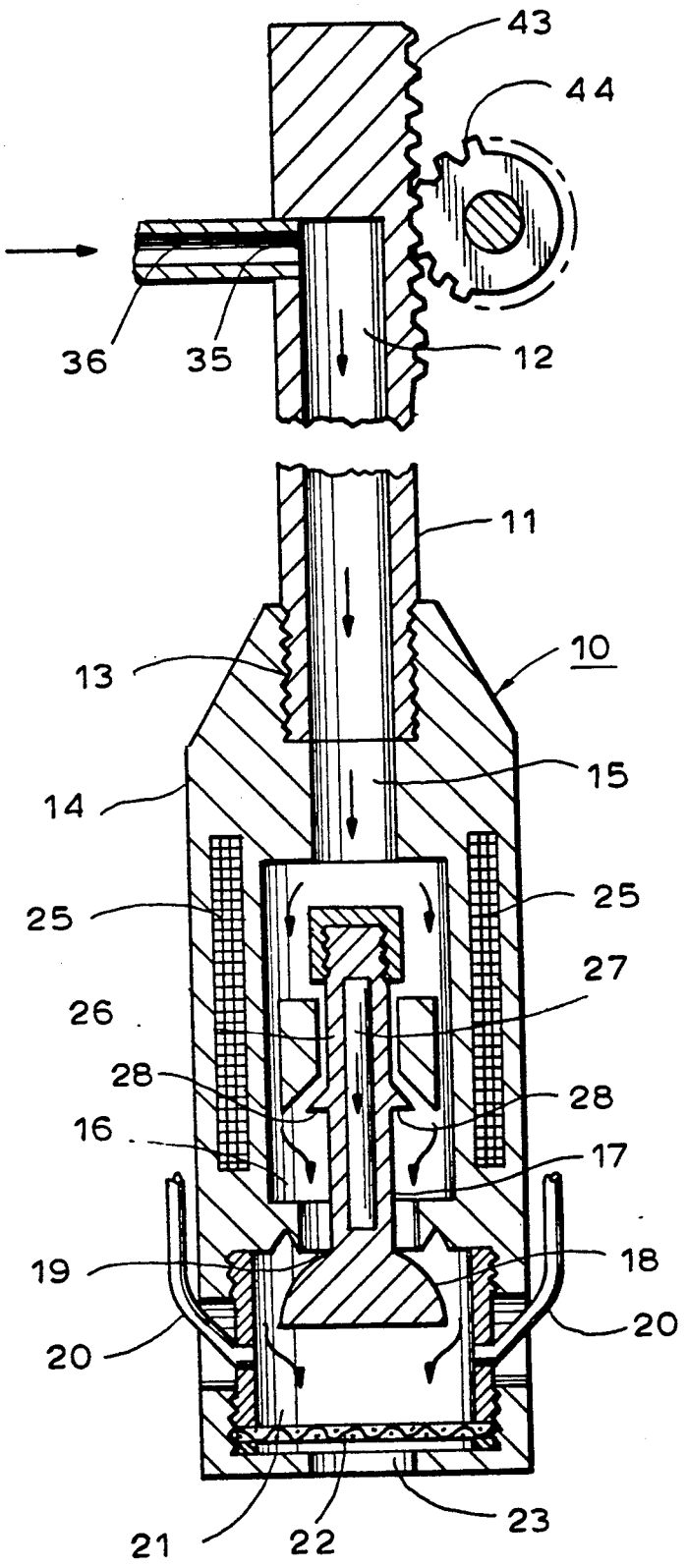
FIG. 2 is an elevational view in section of the fill nozzle assembly in an open position.

In FIG. 1, the fill nozzle 10 is shown in a closed position. In this position, no liquid can exit through opening 23 of the nozzle 10. The nozzle consists of body 14 which receives liquid through channel 12 of conduit 11. Liquid is received from conduit 36 through opening 35. This conduit 11 also supports the nozzle and provides the means for raising and lowering the nozzle during container filling cycles. Conduit 11 threadly engages nozzle body 14 by means of threads 13. Conduit 15 in the nozzle body permits liquid to flow into valve sealing rod housing 16 and to the area of the valve seat 17 of the nozzle. The liquid passes around valve sealing rod guide 26 of valve sealing rod 18 to the region of valve seat 17. The lower part of the valve sealing rod contacts the valve seat when the valve is in a closed position. This will stop the flow of liquid. When in an open position as shown in FIG. 2, the conduit 15 will communicate with chamber 21 with liquid flowing from conduit 15 into chamber 21. At the lower part of chamber 21, there are one or more screens 22 adapted to induce a laminar flow to the liquid that is being flowed. After flowing through the screen the liquid will exit the nozzle through aperture 23. Communicating with chamber 21 are one or more conduits 20 which serve to remove any excess liquid from chamber 21 after the flow of liquid from conduit 15 to chamber 21 ceases. This liquid is removed by means of a suction drawn on conduits 20.

The nozzle 10 is preferably an electromechanical device, but it could be a mechanical device. As an electromechanical nozzle, a magnetic field induced in coils 25 causes the magnet 27 to move upwardly. The magnet is an integral part of valve sealing rod guide 26. Stops 28 as well as the sealing rod 18 will limit the movement of stem 17.

FIG. 2 shows the nozzle in an open position. The valve stem is in a downward position thus permitting liquid to flow through conduit 15 to chamber 21. The liquid will flow through screen 22 and exit via aperture 23. When the nozzle again closes, a suction is drawn on conduits 20 in order to remove excess liquid from chamber 21.

Figure 3:
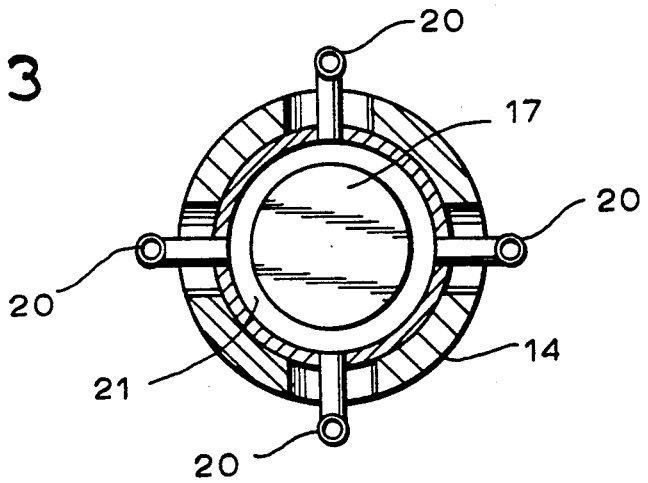
FIG. 3 is a cross-sectional view of the fill nozzle assembly of FIG. 1 along line 3—3.

FIG. 3 shows a cross-section of the nozzle along line 3—3 of FIG. 1. Here there is shown nozzle body 14, chamber 21, valve stem 17 and suction conduits 20.

Figure 4:
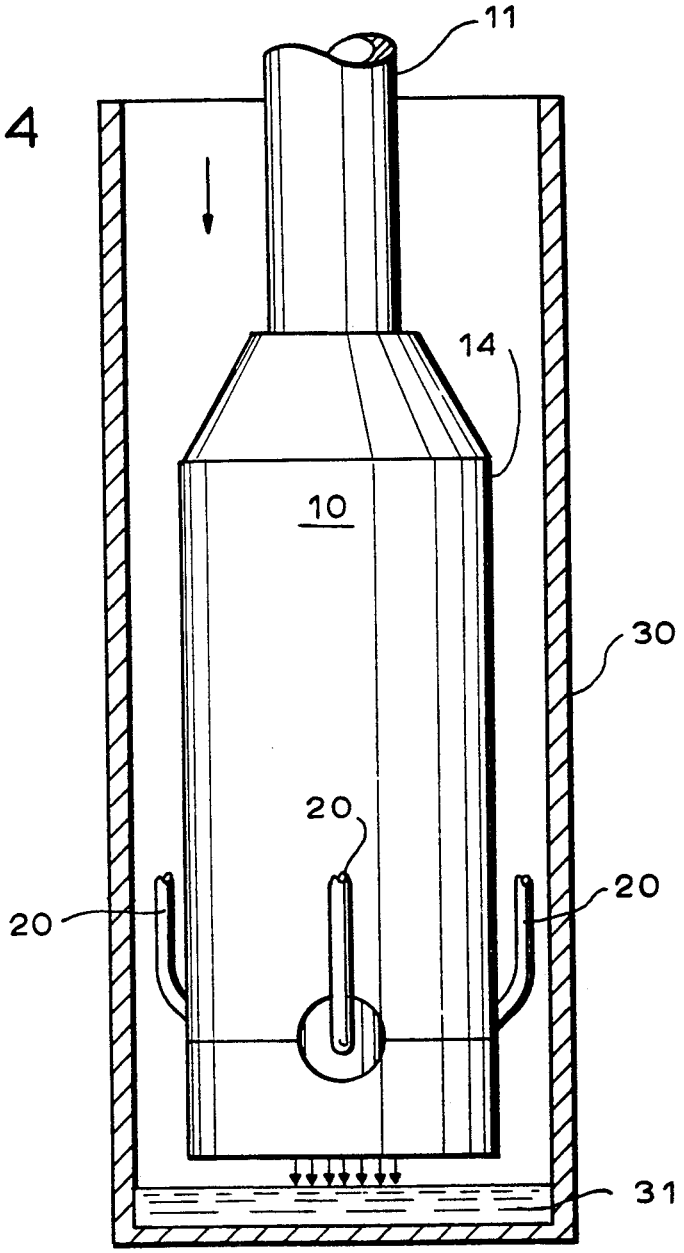
FIG. 4 is an elevational view of the fill nozzle at the start of the filling of a container.
Figure 5:
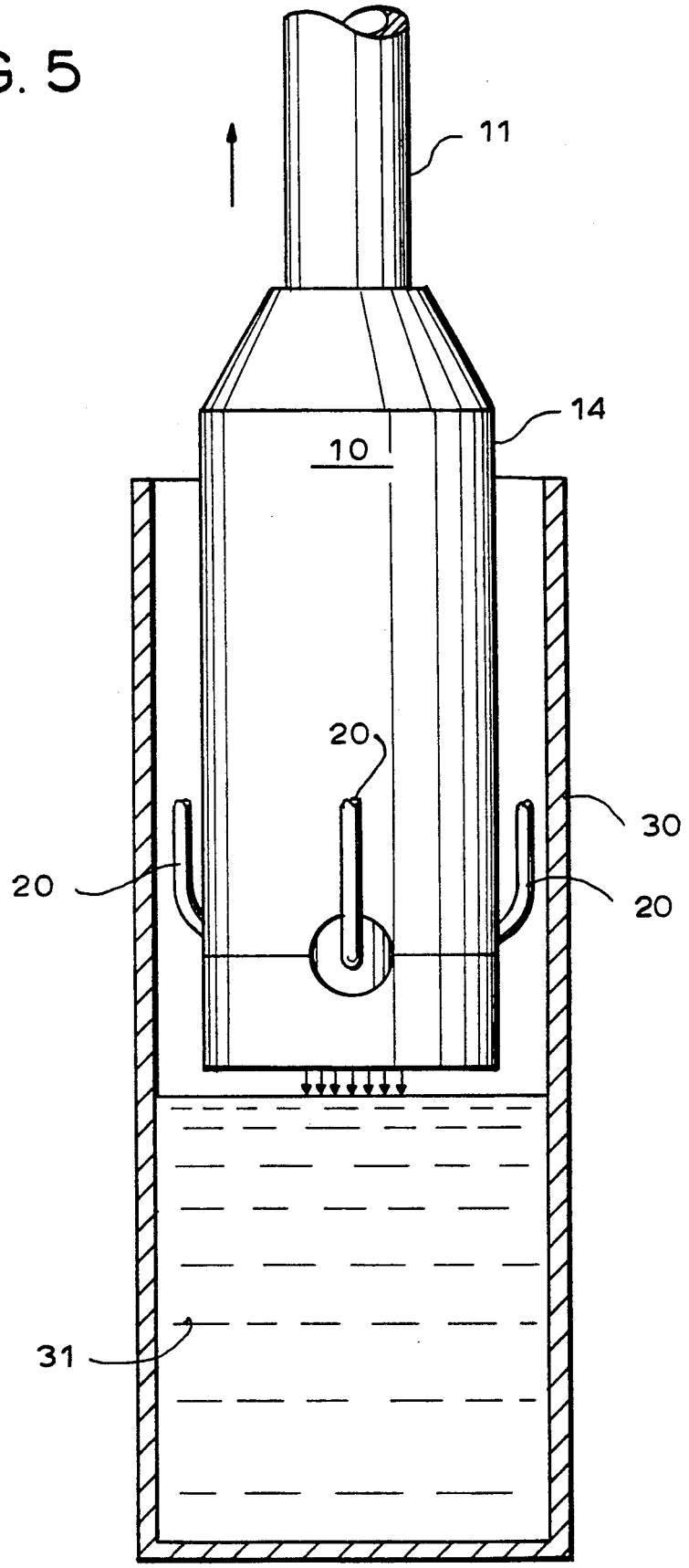
FIG. 5 is an elevational view of the fill nozzle with the container above half full.
Figure 6:
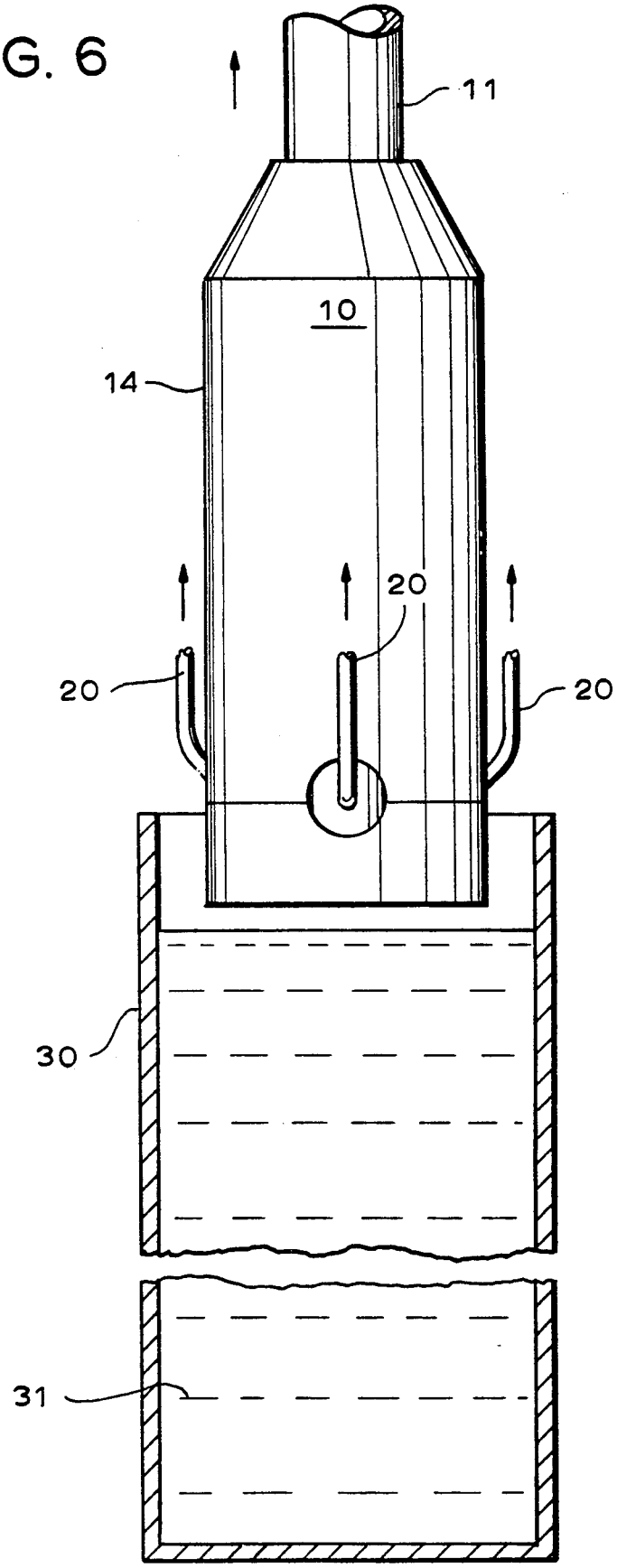
FIG. 6 is an elevational view of the fill nozzle with the container having been filled.

FIGS. 4 to 6 show the nozzle filling a container. In FIG. 4, nozzle 10 is shown to be fully within container 30 and filling the liquid 31 into the container. The liquid flows from nozzle 10 in an essentially laminar flow. This is the result of having passed through the screen. In FIG. 5, the container 30 is shown to be about half full of liquid. In this view, the nozzle 10 has moved upwardly to keep the aperture 23 of the nozzle just above the level of the liquid 31 in the container. In FIG. 6, the container 30 is shown to be full. The nozzle is located above the level of the liquid and the flow of liquid from the nozzle has ceased. At this point, a suction is drawn on conduits 20 so as to remove excess liquid from the lower part of the nozzle, i.e., from the region of the screen or screens.

The primary functions of the screen or screens 22 are to impart a laminar flow to the liquid exiting the nozzle and to aid in preventing drip from the nozzle when it is in a closed position. This screen can be a single screen or a plurality of stacked screens. It is preferred that a single screen be used and that it have a thickness of about 0.1 mm (milimeters) to 10 mm and preferably about 0.2 mm to 5 mm. The screen will have a mesh opening of about 0.1 to 5 mm, and preferably about 0.5 to 2.5 mm. This will be sufficient to produce channels through which the liquid will flow thus inducing an essentially laminar flow.

It is also preferred that the nozzle be of a diameter to essentially fill the cross-section of the container during filling. For a pouch, this will be about 60 to 90 percent of the diameter of the container. When the container is a jar, this will be about 60 to 90 percent of the neck opening of the jar. A larger diameter nozzle will produce less splashing since the liquid will flow at a lower velocity. In addition, the risk of highly turbulent flow is minimized. In this way splashing and the contamination of the inner walls of the container is reduced.

The nozzle 10 is moved upwardly and downwardly either mechanically, hydraulically or pneumatically. In hydraulic or pneumatic actuation, there will be a piston directly or indirectly affixed to conduit 11. A liquid or a gas acting on this piston will raise and lower nozzle 10. In a mechanical operation, the conduit 11 can have a gear such as a rack gear as a part of its exterior surface. Then a gear meshing with this rack will raise and lower the nozzle. Other mechanical arrangements can also be used. In FIG. 1, there is shown an hydraulic or pneumatic technique for raising and lowering nozzle 10. There is shown here bar 37 which is connected to piston rod 38 of piston 39 which moves in cylinder 40. Cylinder 40 is braced on support 41. A fluid or a gas is pumped into aperture 42' or aperture 42" in order to move the piston and thus valve 10. A mechanical technique is shown in FIG. 2. Here gear rack 43 is rigidly attached to conduit 11. The rotation of gear 44 causes the nozzle 10 to move upwardly and downwardly.

In filling a film pouch, the nozzle is moved downwardly to near the bottom of the pouch and liquid flow into the pouch is initiated. As the liquid flows into the pouch, the nozzle is moved upwardly in order to maintain the bottom of the nozzle above the level of the liquid in the pouch. When the given amount of liquid has been flowed into the pouch, the flow of liquid ceases and a suction is drawn on the bottom portion of the valve in order to prevent drip formation. Excess liquid is drawn from the area of the one or more screens of the nozzle into a recycle tank. The suction is then terminated and nozzle is ready to be lowered and another cycle commenced.

A prime objective of this filling nozzle is to prevent the liquid that is being filled into pouches and other containers from splashing up around the fill nozzle and wetting the film in the area where a seal will have to be made in a subsequent step. If the area that is to comprise the seal has been wetted with product, there is the potential for a weaker seal being formed.

The foregoing sets out the preferred modes of the present invention. Modifications and variations can be made to suit particular purposes. However, such modifications and variations would constitute a practice of the present invention.

What is claimed is:

1. A method of filling a container with a liquid comprising:
   (a) providing an elongated tubular nozzle having a channel therethrough for the delivery of a liquid to a container including a plurality of screens and suction means adjacent to said screens;
   (b) moving said nozzle into a container to adjacent the bottom of said container;
   (c) flowing a liquid through said nozzle and moving a exit end of said nozzle to maintain said nozzle exit end above the level of the liquid in the container;
   (d) ceasing the flow of liquid from said nozzle; and
   (e) activating said suction means to remove liquid from the region of said plurality of screens.

2. A method as in claim 1 wherein the liquid removed by said suction means is flowed to a recycle tank.

3. A method as in claim 1 wherein said liquid is selected from the group consisting of bleach, detergent, fabric softener and lotions.

4. A method as in claim 3 wherein said liquid is bleach.

5. A method as in claim 3 wherein said liquid is fabric softener.

6. A method as in claim 3 wherein said package is a flexible film pouch.

7. An anti-drip nozzle for filling containers with liquids comprising an elongated tubular member having an aperture therethrough for the flow of a liquid, means at the upper end of said tubular member for the introduction of a liquid, at least one screen means at the other end of said tubular member to direct flow and to decrease drip formation, at least one suction means in the region adjacent to a screen to remove excess liquid on said at least one screen means and means to raise said tubular member during the filling of said container from a position adjacent the bottom of the container to maintain the at least one screen means on the other end of said tubular member above the rising level of the liquid in the container being filled.

8. An anti-drip nozzle as in claim 7 wherein said at least one screen means is comprised of a plurality of screens.

9. An anti-drip nozzle as in claim 8 wherein said plurality of screens have a thickness of about 0.1 to 10 cm.

10. An anti-drip nozzle as in claim 7 wherein there are a plurality of suction means.

11. An anti-drip nozzle as in claim 7 wherein said elongated member substantially fills the cross-section of the container being filled.

* * * * *